US008876262B2

(12) United States Patent
Arai et al.

(10) Patent No.: US 8,876,262 B2
(45) Date of Patent: Nov. 4, 2014

(54) INKJET HEAD AND INKJET RECORDING APPARATUS

(75) Inventors: Ryuichi Arai, Numazu (JP); Chiaki Tanuma, Tokyo (JP); Ryutaro Kusunoki, Mishima (JP); Shuhei Yokoyama, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/600,495

(22) Filed: Aug. 31, 2012

(65) Prior Publication Data

US 2013/0070027 A1 Mar. 21, 2013

(30) Foreign Application Priority Data

Sep. 21, 2011 (JP) ..... 2011-206102
Jul. 20, 2012 (JP) ..... 2012-161723

(51) Int. Cl.
*B41J 2/045* (2006.01)
*B41J 2/14* (2006.01)
*B41J 2/155* (2006.01)
*B41J 2/16* (2006.01)

(52) U.S. Cl.
CPC ..... *B41J 2/14298* (2013.01); *B41J 2/14072* (2013.01); *B41J 2/1631* (2013.01); *B41J 2/14233* (2013.01); *B41J 2/155* (2013.01); *B41J 2002/14491* (2013.01)
USPC ..... 347/70; 347/50; 347/58; 347/71; 347/72; 347/47

(58) Field of Classification Search
USPC ..... 347/70–72, 47, 50, 58
See application file for complete search history.

(56) References Cited

U.S. PATENT DOCUMENTS 6,631,981 B2 * 10/2003 Isono et al. ..... 347/72
2011/0037813 A1 * 2/2011 Nakatani ..... 347/70
2011/0199437 A1 * 8/2011 Miyata ..... 347/68

FOREIGN PATENT DOCUMENTS

JP 2000-190490 7/2000
JP 2009-096128 5/2009
JP 2011-056939 3/2011
JP 2011-093105 5/2011

OTHER PUBLICATIONS

First Office Action for Japanese Patent Application No. 2012-161723 Dated Feb. 4, 2014, 5 pgs.

* cited by examiner

*Primary Examiner* — Henok Legesse
(74) *Attorney, Agent, or Firm* — Amin, Turocy & Watson, LLP

(57) ABSTRACT

According to one embodiment, an inkjet head includes actuators configured to pressurize ink. The actuators include piezoelectric elements provided on an insulating layer, first electrodes electrically connected to the piezoelectric elements, and second electrodes connected to the piezoelectric elements and configured to hold the piezoelectric elements in cooperation with the first electrodes. The first electrodes of all the actuators are electrically connected to a common first energization pattern. The second electrodes of all the actuators are individually electrically connected to second energization patterns. The first energization pattern and the second energization patterns are separated from each other without overlapping each other on the insulating layer.

16 Claims, 11 Drawing Sheets

INKJET HEAD AND INKJET RECORDING APPARATUS

CROSS-REFERENCE TO RELATED APPLICATIONS

This application is based upon and claims the benefit of priority from Japanese Patent Applications No. 2011-206102, filed on Sep. 21, 2011; and No. 2012-161723, filed on Jul. 20, 2012, the entire contents of all of which are incorporated herein by reference.

FIELD

Embodiments described herein relate generally to an inkjet head including plural nozzles for ejecting ink and an inkjet recording apparatus including the inkjet head.

BACKGROUND

An inkjet head includes plural nozzles and plural actuators corresponding to the respective nozzles. The actuators are provided on a base material such as a silicon substrate. The actuators include piezoelectric elements and common electrodes and individual electrodes that apply a voltage to the piezoelectric elements. The piezoelectric elements are held between the common electrodes and the individual electrodes.

The common electrodes and the individual electrodes are electrically connected to tape carrier packages via plural conductor patterns formed on the base material. The tape carrier package is mounted with a driving circuit that drives the actuators.

When an electric field is applied from the driving circuit to the piezoelectric elements via the common electrodes and the individual electrodes, the piezoelectric elements are deformed to pressurize ink. A part of the pressurized ink is ejected from nozzles to a recording medium as ink droplets to form an image on the recording medium.

In the inkjet head including the actuators in which the piezoelectric elements are held between the common electrodes and the individual electrodes, the two kinds of electrodes are laminated in the thickness direction of the base material on the base material. Therefore, in order to electrically separate a conductor pattern connected to the common electrodes and a conductor pattern connected to the individual electrodes, it is necessary to interpose an insulating film between the conductor patterns. Therefore, an exclusive insulating film has to be formed between the conductor patterns. It is inevitable that a process for manufacturing the inkjet head is complicated.

DETAILED DESCRIPTION

In general, according to one embodiment, an inkjet head includes a plurality of nozzles arrayed spaced apart from one another and a plurality of actuators provided for the respective nozzles and configured to pressurize ink and eject the ink from the nozzles. The actuators include piezoelectric elements provided on an insulating layer, first electrodes electrically connected to the piezoelectric elements, and second electrodes electrically connected to the piezoelectric elements and configured to hold the piezoelectric elements in cooperation with the first electrodes. The first electrodes of all the actuators are electrically connected to a common first energization pattern. The second electrodes of all the actuators are individually electrically connected to a plurality of second energization patterns. The first energization pattern and the second energization patterns are separated from each other without overlapping each other on the insulating layer.

First Embodiment

A first embodiment is explained with reference to FIGS. 1 to 20.

Figure 1:
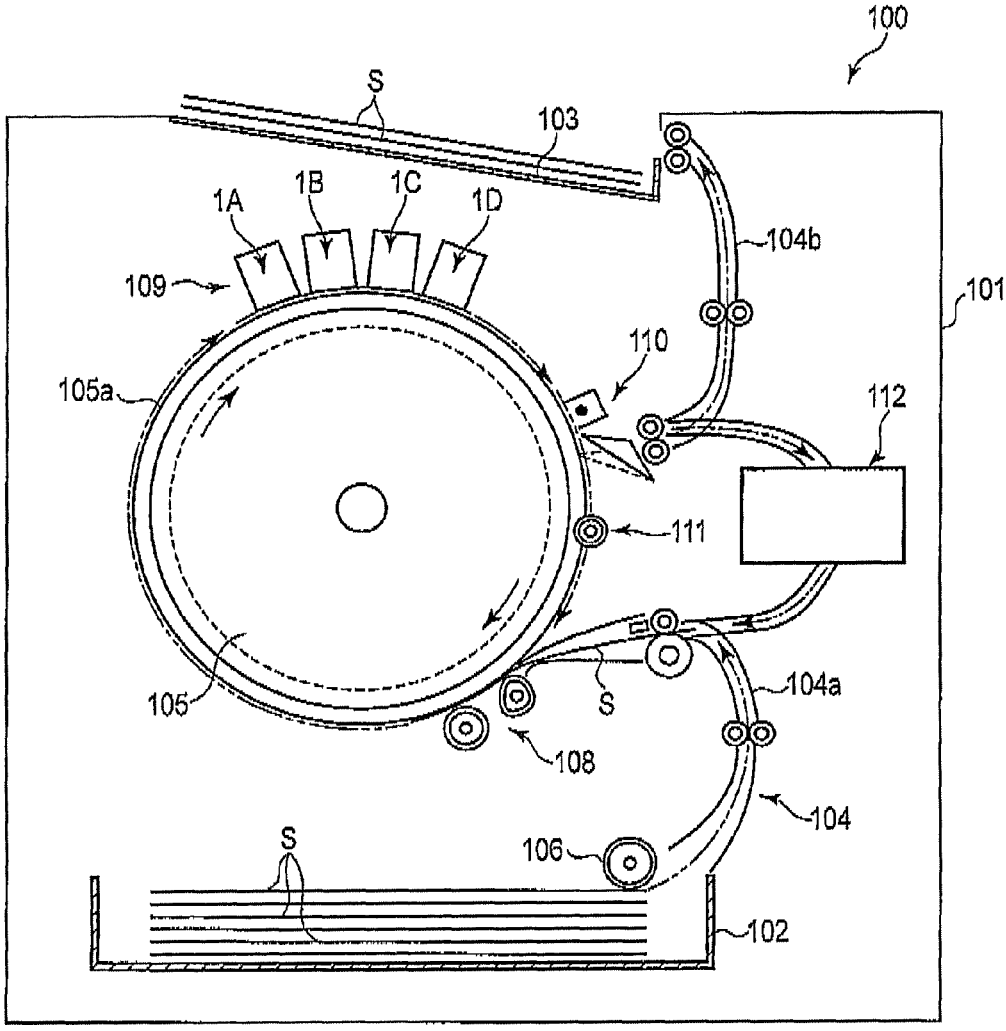
FIG. 1 is an exemplary schematic side view of an inkjet recording apparatus according to a first embodiment.

FIG. 1 is a schematic diagram of an example of an inkjet recording apparatus 100. The inkjet recording apparatus 100 includes a box-like housing 101 that forms the outer hull of the inkjet recording apparatus 100. As shown in FIG. 1, a paper feeding cassette 102, a paper discharge tray 103, a conveying path 104, and a holding drum 105 are housed on the inside of the housing 101.

The paper feeding cassette 102 is a component that stores sheets S, which are an example of recording media. The paper feeding cassette 102 is arranged in the bottom of the housing 101. As the sheets S, for example, plain sheets, art paper, OHP sheets, and the like can be used. The paper discharge tray 103 is provided in an upper part of the housing 101 and exposed to the outside of the housing 101.

The conveying path 104 includes an upstream section 104*a* continuous to the paper feeding cassette 102 and a downstream section 104*b* continuous to the paper discharge tray 103. The sheets S stored in the paper feeding cassette 102 are delivered to the upstream section 104*a* of the conveying path 104 by a roller 106 one by one.

The holding drum 105 is arranged between the paper feeding cassette 102 and the paper discharge tray 103. The sheet S delivered from the paper feeding cassette 102 to the upstream section 104*a* of the conveying path 104 is led to the downstream section 104*b* of the conveying path 104 through an outer circumferential surface 105*a* of the holding drum 105. Specifically, the holding drum 105 is configured to rotate at constant speed in the circumferential direction in a state in which the holding drum 105 holds the sheet S on the circumferential surface 105*a*.

As shown in FIG. 1, a sheet pressing device 108, an image forming device 109, a charge removing device 110, and a cleaning device 111 are arranged around the holding drum 105. The sheet pressing device 108, the image forming device 109, the charge removing device 110, and the cleaning device 111 are arranged in order from upstream to downstream along the rotating direction of the holding drum 105.

The sheet pressing device 108 presses the sheet S, which is supplied from the upstream section 104*a* of the conveying path 104 to the outer circumferential surface 105*a* of the holding drum 105, against the outer circumferential surface 105*a* of the holding drum 105. The sheet S pressed against the outer circumferential surface 105*a* of the holding drum 105 is attracted to the outer circumferential surface 105*a* of the holding drum 105 by an electrostatic force.

The image forming device 109 is a component for forming an image on the sheet S attracted to the outer circumferential surface 105*a* of the holding drum 105. The image forming device 109 in this embodiment includes, for example, a first inkjet head 1A that forms a cyan image, a second inkjet head 1B that forms a magenta image, a third inkjet head 1C that forms a yellow image, and a fourth inkjet head 1D that forms a black image. The first to fourth inkjet heads 1A, 1B, 1C, and 1D are arrayed spaced apart from one another in the rotating direction of the holding drum 105. The rotating direction of the holding drum 105 can be rephrased as a conveying direction of the sheet S conveyed along the outer circumferential surface 105*a* of the holding drum 105.

The charge removing device 110 has a function of removing charges of the sheet S on which a desired image is formed and peeling the sheet S off the outer circumferential surface 105*a* of the holding drum 105 after the charge removal. The sheet S peeled off the outer circumferential surface 105*a* of the holding drum 105 is led to the paper discharge tray 103 through the downstream section 104*b* of the conveying path 104.

The cleaning device 111 has a function of cleaning the outer circumferential surface 105*a* of the holding drum 105 from which the sheet S is peeled. Further on a downstream side along the rotating direction of the holding drum 105 than the charge removing device 110, the cleaning device 111 is movable between a position where the cleaning device 111 is in contact with the outer circumferential surface 105*a* of the holding drum 105 and a position where the cleaning device 111 is separated from the outer circumferential surface 105*a* of the holding drum 105.

Further, the inkjet recording apparatus 100 according to this embodiment includes a reversing device 112 that reverses the front and the back of the sheet S. The reversing device 112 reverses the sheet S, which is peeled off the outer circumferential surface 105*a* of the holding drum 105 by the charge removing device 110, and returns the sheet S to the upstream section 104*a* of the conveying path 104. Consequently, the sheet S is supplied to the outer circumferential surface 105*a* of the holding drum 105 again in a state in which the front and the back of the sheet S are reversed. Therefore, it is possible to form desired images on both the front and rear surfaces of the sheet S.

The first to fourth inkjet heads 1A, 1B, 1C, and 1D included in the image forming device 109 basically include a common configuration. Therefore, in this embodiment, the configuration of the first inkjet head 1A is representatively explained.

Figure 2:
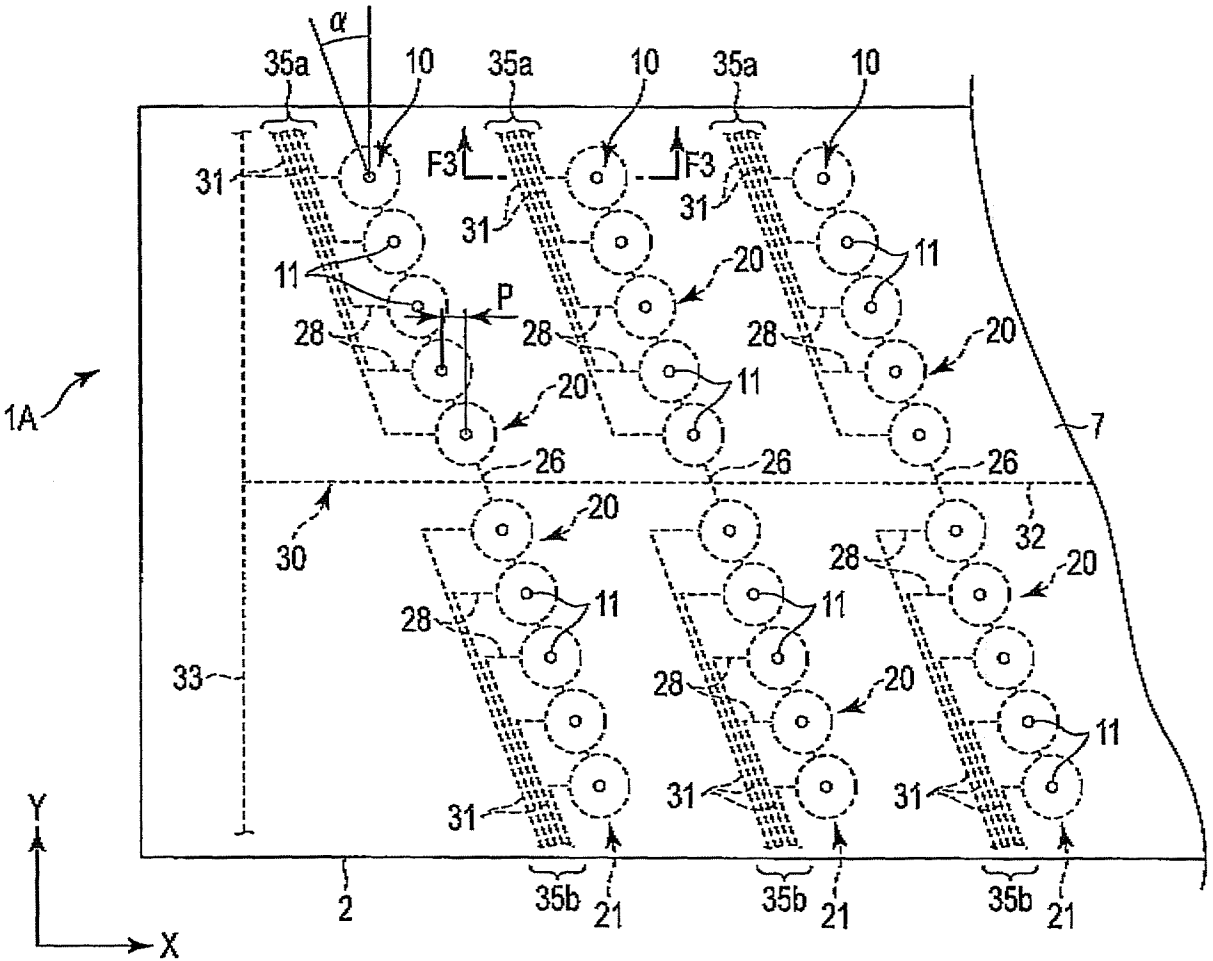
FIG. 2 is an exemplary plan view of an inkjet head according to the first embodiment.
Figure 3:
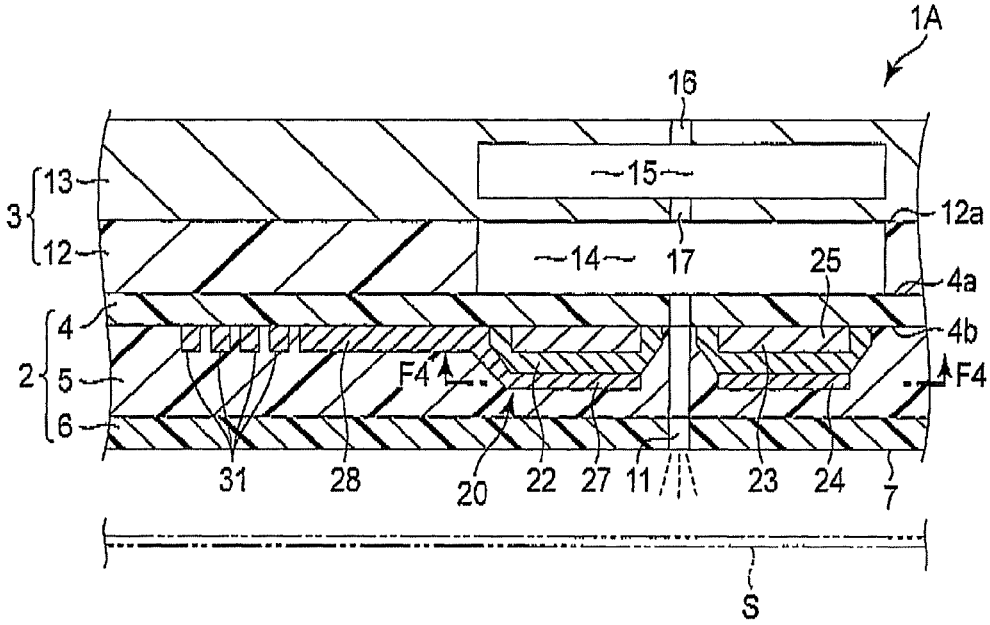
FIG. 3 is an exemplary sectional view taken along line F3-F3 shown in FIG. 2.
Figure 4:
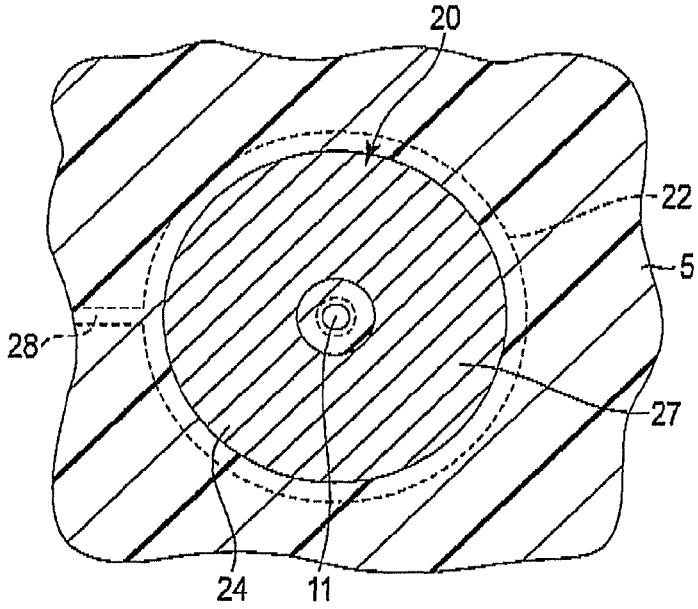
FIG. 4 is an exemplary sectional view taken along line F4-F4 shown in FIG. 3.

As shown in FIGS. 2 to 4, the first inkjet head 1A has an elongated shape extending in the direction orthogonal to the conveying direction of the sheet S. As shown in FIG. 3, the first inkjet head 1A includes a nozzle plate 2 and a head main body 3. The nozzle plate 2 has a three-layer structure including a vibrating plate 4, a protective layer 5, and a liquid repellent film 6.

The vibrating plate 4 is an example of an insulating layer and formed of, for example, a silicon oxide film having electric insulation properties. The vibrating plate 4 includes a front surface 4*a* and a rear surface 4*b*. The thickness of the vibrating plate 4 is about 10 μm. In the first embodiment, the silicon oxide film is formed by thermal oxidation with substrate temperature set to about 1000° C. As a manufacturing method for the silicon oxide film, a CVD (chemical vapor deposition) or an RF magnetron sputtering method can be used.

The protective layer 5 is laminated on the rear surface 4*b* of the vibrating plate 4. The protective layer 5 is formed of a resin material such as polyimide. The thickness of the protective layer 5 is 6 μm. In the first embodiment, the protective layer 5 is formed by, for example, spin coating. As the material of the protective layer 5, for example, a resin material such as polyurea or an oxide film of $SiO_2$ or the like can also be used. In this case, the thickness of the protective layer 5 is about 3 μm to 20 μm.

The liquid repellent film 6 is laminated on the protective layer 5. The liquid repellent film 6 is formed of, for example, a material having a characteristic for repelling ink such as fluorocarbon resin. In the first embodiment, the liquid repellent film 6 is formed by, for example, the spin coating. The thickness of the liquid repellent film 6 is about 0.1 μm to 5 μm and preferably 1 μm. The liquid repellent film 6 forms a nozzle surface 7, which is the surface of the nozzle plate 2. The nozzle surface 7 is exposed to the outside of the first inkjet head 1A to face a surface to be printed of the sheet S.

As shown in FIG. 2, plural nozzle rows 10 are formed on the nozzle plate 2. The nozzle rows 10 are arranged in a row spaced apart from one another in the longitudinal direction of the first inkjet head 1A indicated by an arrow X. The longitudinal direction of the first inkjet head 1A means the direction orthogonal to the conveying direction of the sheet S indicated by the arrow Y. The longitudinal direction of the first inkjet head 1A coincides with the width direction of the sheet S.

Each of the nozzle rows 10 includes, for example, ten nozzles 11. The nozzles 11 are linearly regularly arrayed spaced apart from one another in an oblique direction having a fixed angle α with respect to the conveying direction of the sheet S.

The nozzles 11 are holes that pierce through the nozzle plate 2 in the thickness direction. The diameter of the nozzles 11 is, for example, 20 μm. The nozzles 11 are opened in the nozzle surface 7 of the nozzle plate 2 and the front surface 4*a* of the vibrating plate 4 located on the opposite side of the nozzle surface 7.

According to the first embodiment, the nozzle rows 10 extend along the conveying direction of the sheet S and arranged in one hundred and twenty rows along the longitudinal direction of the nozzle plate 2 orthogonal to the conveying direction of the sheet S.

Therefore, the nozzle plate 2 in the first embodiment includes one thousand and two hundred nozzles 11. The nozzles 11 form a nozzle group two-dimensionally arrayed in a matrix shape at least over the length along the width direction of the sheet S.

Further, all the nozzles 11 opened in the nozzle surface 7 are arranged at a fixed pitch P in the longitudinal direction of the nozzle plate 2 in order to obtain desired resolution.

The head main body 3 includes a first substrate 12 and a second substrate 13. The first substrate 12 is formed of, for example, a single silicon substrate. The thickness of the first substrate 12 is, for example, 675 μm. The first substrate 12 is laminated on the front surface 4*a* of the vibrating plate 4 and integrated with the vibrating plate 4.

Ink pressure chambers 14 are formed in the first substrate 12 in the same number as the nozzles 11. The ink pressure chambers 14 are formed in, for example, a cylindrical shape having a diameter of 250 μm. The ink pressure chambers 14 pierce through the first substrate 12 in the thickness direction to be coaxial with the nozzles 11. Therefore, the pitch P of the nozzles 11 is set to a value for preventing the ink pressure chambers 14 incidental to the nozzles 11 from interfering with the ink pressure chambers 14 of the nozzles 11 adjacent to the nozzles 11.

One opening ends of the ink pressure chambers 14 are closed by the vibrating plate 4. In other words, the vibrating plate 4 is exposed to the ink pressure chambers 14. The ink pressure chambers 14 are provided to correspond to the nozzles 11. The nozzles 11 are provided to respectively communicate with the centers of the ink pressure chambers 14.

The second substrate 13 is made of a metal material such as stainless steel. The thickness of the second substrate 13 is, for example, 4 mm. The second substrate 13 is laminated on a surface 12*a* of the first substrate 12 and fixed to the first substrate 12 using, for example, an epoxy adhesive.

Plural ink circulation chambers 15 are formed on the inside of the second substrate 13. The ink circulation chambers 15 are formed in, for example, a cylindrical shape that is 2 mm deep along the thickness direction of the second substrate 13. Ink for image formation is supplied from the outside of the first inkjet head 1A to the ink circulation chambers 15 through ink supply ports 16.

The ink circulation chambers 15 communicate with the ink pressure chambers 14 through communicating ports 17. The communicating ports 17 are holes having a diameter smaller than the nozzle 11. The communicating ports 17 are formed in the second substrate 13 to be coaxial with the nozzles 11. The ink distributed from the ink supply ports 16 to the ink circulation chambers 15 is supplied to the ink pressure chambers 14 through the communicating ports 17.

In the first embodiment, the ink supply ports 16 are located in the centers of the ink circulation chambers 15. Further, the communicating ports 17 are also located in the centers of the ink circulation chambers 15 and the centers of the ink pressure chambers 14. As a result, channel resistance applied when the ink is supplied from the plural ink circulation chambers 15 to the plural ink pressure chambers 14 is equalized. Fluctuation in an amount of the ink supplied to the ink pressure chambers 14 is suppressed.

The second substrate 13 is not limited to stainless steel and may be formed of other metal materials such as an aluminum alloy and titanium. In addition, a material forming the second substrate 13 is not limited to metal. For example, taking into account a difference between the expansion coefficients of the nozzle plate 2 and the first substrate 12, it is possible to use other materials as long as the materials do not affect ink ejection pressure.

Specifically, nitrides and oxides such as alumina, zirconium, silicon carbide, silicon nitride, and barium titanate serving as ceramic materials can be used. Further, plastic materials such as ABS (acrylonitrile-butadiene-styrene), polyacetal, polyamide, polycarbonate, and polyethersulfone can be used.

As shown in FIGS. 3 and 4, the nozzle plate 2 in the first embodiment incorporates plural actuators 20 that pressurize the ink. The actuators 20 are provided for the respective nozzles 11.

In other words, the actuators 20 form plural actuator rows 21 corresponding to the plural nozzle rows 10. Each of the actuator rows 21 includes ten actuators 20.

Therefore, the actuator rows 21 extend in the conveying direction of the sheet S. The actuator rows 21 are arranged in one hundred and twenty rows along the longitudinal direction of the nozzle plate 2 orthogonal to the conveying direction of the sheet S.

The actuators 20 are formed in a ring shape on the rear surface 4*b* of the vibrating plate 4 to coaxially surround the nozzles 11. Further, the actuators 20 are covered with the protective layer 5.

Each of the actuators 20 includes a piezoelectric layer 22, a first electrode 23, and a second electrode 24. The piezoelectric layer 22 is an example of a piezoelectric element. The piezoelectric layer 22 is formed of, for example, PZT (lead zirconate titanate). As the material of the piezoelectric layer 22, PTO ($PbTiO_3$: lead titanate), PMNT($Pb(Mg_{1/3}Nb_{2/3})O_3$—$PbTiO_3$), PZNT($Pb(Zn_{1/3}Nb_{2/3})O_3$—$PbTiO_3$), ZnO, AlN, and the like can also be used.

The piezoelectric layer 22 is formed at substrate temperature of 350° C. by, for example, the RF magnetron sputtering method. The piezoelectric layer 22 is formed in a ring shape having a thickness of 3 μm and a diameter of 250 μm. In the first embodiment, after the piezoelectric layer 22 is formed, heat treatment is applied to the piezoelectric layer 22 at 500° C. for three hours in order to impart piezoelectricity to the piezoelectric layer 22. Consequently, the piezoelectric layer 22 can obtain satisfactory piezoelectric performance. When the piezoelectric layer 22 is formed, polarization along the thickness direction of the piezoelectric layer 22 occurs.

As a manufacturing method for the piezoelectric layer 22, a CVD (chemical vapor deposition), a sol-gel method, an AD method (aerosol deposition method), a hydrothermal method, and the like can be used. In this case, the thickness of the piezoelectric layer 22 is in a range of about 0.1 μm to 10 μm.

The first electrode 23 and the second electrode 24 are components for transmitting an electric signal for driving the piezoelectric layer 22. The first electrode 23 and the second electrode 24 are formed of a thin film of, for example, Pt (platinum) and Ti (titanium). The thin film is formed by, for example, a sputtering method. The thickness of the thin film is 0.5 μm.

As other materials forming the first electrode 23 and the second electrode 24, Ni (nickel), Cu (copper), Al (aluminum), Ti (titanium), W (tungsten), Mo (molybdenum), and Au (gold) can be used. The various kinds of metal can be laminated.

As a method of forming the first electrode 23 and the second electrode 24, for example, vapor deposition and plating can also be used. In this case, desired thickness of the first electrode 23 and the second electrode 24 is 0.01 to 1 μm.

Figure 5:
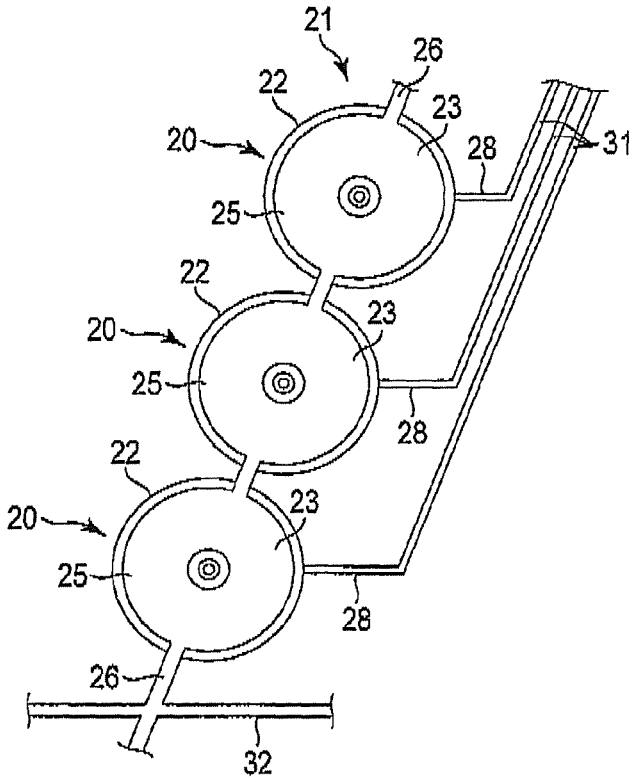
FIG. 5 is an exemplary plan view for explaining a positional relation between a wiring portion connected to a common electrode of an actuator and a wiring portion connected to individual electrodes of the actuator in the first embodiment.

As shown in FIG. 3, the first electrodes 23 are formed on the rear surface 4*b* of the vibrating plate 4. Each of the first electrodes 23 includes an electrode portion 25 and a wiring portion 26. As shown in FIG. 5, the electrode portion 25 has a ring shape smaller in diameter than the piezoelectric layer 22. The electrode portion 25 is coaxially covered with the piezoelectric layer 22 and electrically connected to the piezoelectric layer 22.

The wiring portion 26 linearly extends along the actuator row 21 to connect the outer circumferential portions of the adjacent electrode portions 25 in each of the actuator rows 21. Therefore, the wiring portion 26 is projected from the outer circumferential portion of the piezoelectric layer 22 onto the rear surface 4*b* of the vibrating plate 4. The length of the wiring portion 26 connecting the fifth actuator 20 and the sixth actuator 20 of each of the actuator rows 21 is the largest.

Each of the second electrodes 24 includes an electrode portion 27 and a wiring portion 28. The electrode portion 27 has a ring shape smaller in diameter than the piezoelectric layer 22. The electrode portion 27 is coaxially laminated on the piezoelectric layer 22 and electrically connected to the piezoelectric layer 22.

Therefore, the piezoelectric layer 22 is held between the electrode portion 25 of the first electrode 23 and the electrode portion 27 of the second electrode 24. The nozzle 11 coaxially pierces through the center of the piezoelectric layer 22, the center of the electrode portion 25 of the first electrode 23, and the center of the electrode portion 27 of the second electrode 24.

The wiring portion 28 is led from the outer circumferential edge of the electrode portion 27 to the rear surface 4*b* of the vibrating plate 4 through the outer circumferential portion of the piezoelectric layer 22. The wiring portion 28 extends, for example, along the longitudinal direction of the nozzle plate 2 to cross the direction in which the actuator row 21 extends.

In other words, the wiring portion 28 of the second electrode 24 extends in a direction different from the direction in which the wiring portion 26 of the first electrode 23 extends. Therefore, the wiring portions 28 are arrayed spaced apart from one another in the Y direction, which is the conveying direction of the sheet S, in each of the actuator rows 21.

Therefore, the wiring portion 26 of the first electrode 23 and the wiring portion 28 of the second electrode 24 are separated from each other without overlapping each other on the same rear surface 4*b* of the vibrating plate 4.

As shown in FIGS. 2 and 5, a first energization pattern 30 and plural second energization patterns 31 are formed on the rear surface 4*b* of the vibrating plate 4. The first energization pattern 30 and the second energization patterns 31 are covered with the protective layer 5 together with the actuators 20.

The first energization pattern 30 includes common one trunk wire 32. The trunk wire 32 linearly extends in the longitudinal direction of the nozzle plate 2 passing between the fifth actuator 20 and the sixth actuator 20 of each of the actuator rows 21.

Further, the trunk wire 32 includes an extending portion 33. The extending portion 33 extends in a direction orthogonal to the trunk wire 32 at an end of the nozzle plate 2. The distal end of the extending portion 33 is led to the outer circumferential edge extending along the longitudinal direction of the nozzle plate 2. The wiring width of the trunk wire 32 including the extending portion 33 is about 100 μm.

As shown in FIGS. 2 and 5, the trunk wire 32 is electrically connected to the wiring portion 26 of the first electrode 23 of each of the actuator rows 21. In other words, the wiring portion 26 extending between the fifth actuator 20 and the sixth actuator 20 of each of the actuator rows 21 is formed to cross the trunk wire 32. Therefore, the wiring portion 26 is divided from the trunk wire 32 in a position corresponding to the actuator row 21.

Therefore, the trunk wire 32 of the first energization pattern 30 is connected to the first electrodes 23 of all the actuators 20 in common. Consequently, the first electrodes 23 act as common electrodes that apply a fixed voltage to all the piezoelectric layers 22.

As shown in FIGS. 2, 3, and 5, the second energization patterns 31 are independently provided in each of the actuator rows 21.

Specifically, in each of the actuator rows 21, the second energization patterns 31 are divided into a first pattern group 35*a* including five second energization patterns 31 as a set and a second pattern group 35*b* including five second energization patterns 31 as a set. The first pattern group 35*a* corresponds to the first to fifth actuators 20. The second pattern group 35*b* corresponds to the sixth to tenth actuators 20.

The first pattern group 35*a* is located further on the downstream side along the conveying direction of the sheet S than the trunk wire 32 on the rear surface 4*b* of the vibrating plate 4. The first pattern groups 35*a* are arranged in parallel spaced apart from one another in a direction crossing the trunk wire 32 to extend along the actuator rows 21. The first pattern groups 35*a* extend in a direction away from the trunk wire 32.

One ends of the five second energization patterns 31 included in the first pattern group 35*a* are individually electrically connected to the distal ends of the wiring portions 28 of the second electrodes 24 of the first to fifth actuators 20. The other ends of the second energization patterns 31 are led to the outer edge extending along the longitudinal direction of the nozzle plate 2.

The second pattern group 35*b* is located further on the upstream side along the conveying direction of the sheet S than the trunk wire 32 on the rear surface 4*b* of the vibrating plate 4. The second pattern groups 35*b* are arranged in parallel spaced apart from one another in the direction crossing the trunk wire 32 to extend along the actuator rows 21. The second pattern groups 35*b* extend in the direction away from the trunk wire 32.

One ends of the five second energization patterns 31 included in the second pattern group 35*b* are individually electrically connected to the distal ends of the wiring portions 28 of the second electrodes 24 of the sixth to tenth actuators 20. The other ends of the second energization patterns 31 are led to the outer edge extending along the longitudinal direction of the nozzle plate 2.

According to the first embodiment, the second energization patterns 31 are wired passing through between the adjacent actuator rows 21. Therefore, the wiring width of the second energization patterns 31 is about 15 μm.

The second energization patterns 31 are individually connected to the second electrodes 24 of all the actuators 20. Consequently, the second electrodes 24 act as individual electrodes that cause the respective piezoelectric layers 22 to independently operate.

Consequently, the second energization patterns 31 are formed in positions where the first energization pattern 30 is not formed on the rear surface 4*b* of the vibrating plate 4. As a result, the first energization pattern 30 and the second energization patterns 31 are kept in an electrically separated state without overlapping each other on the same rear surface 4*b* of the vibrating plate 4.

The first and second energization patterns 30 and 31 led to the outer circumferential edge of the nozzle plate 2 are electrically connected to the tape carrier packages on the outside of the first inkjet head 1A. The tape carrier package is mounted with a driving circuit for driving the first inkjet head 1A.

The driving circuit supplies a driving voltage to the first electrode 23 and the second electrode 24 of each of the actuators 20. When an electric field in the same direction as the direction of the polarization of the piezoelectric layer 22 is applied from the first and second electrodes 23 and 24 to the piezoelectric layer 22, the actuator 20 is about to repeat expansion and contraction in a direction orthogonal to the direction of the electric field. The direction orthogonal to the electric field means a direction along the rear surface 4*b* of the vibrating plate 4.

Since the actuator 20 is formed on the rear surface 4*b* of the vibrating plate 4, the vibrating plate 4 acts to prevent the expansion and contraction of the actuator 20. Therefore, stress is generated in a contact portion of the actuator 20 and the vibrating plate 4. The generated stress deforms the vibrating plate 4 to bend in the thickness direction.

The actuator 20 repeats the expansion and contraction in the direction orthogonal to the direction of the electric field, whereby the vibrating plate 4 exposed to the ink pressure chamber 14 vibrates in the thickness direction. As a result, the pressure of the ink in the ink pressure chamber 14 increases. Therefore, a part of the ink pressurized in the ink pressure chamber 14 is ejected from the nozzles 11 to the sheet S as ink droplets.

An example of a procedure for manufacturing the first inkjet head 1A including the configuration explained above is briefly explained with reference to FIGS. 6 to 20.

Figure 6:
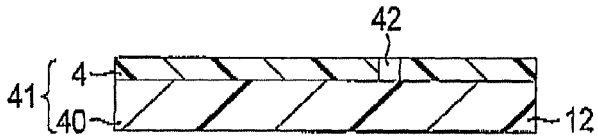
FIG. 6 is an exemplary sectional view of a state in which, in the first embodiment, a vibrating plate is laminated on a base included in a protective layer.

First, as shown in FIG. 6, a laminated body 41 is formed by laminating the vibrating plate 4 on a base 40, which is the base of the first substrate 12. Thereafter, for example, photolithography and dry etching are applied to the vibrating plate 4 to form an opening 42.

Figure 7:
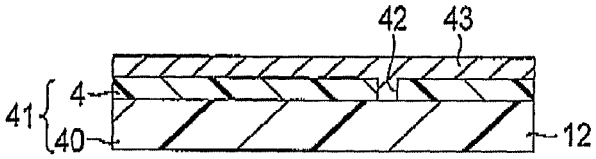
FIG. 7 is an exemplary sectional view of a state in which, in the first embodiment, a thin film, which is the base of a first electrode, is formed on the vibrating plate.

Subsequently, as shown in FIG. 7, a thin film 43 of platinum or titanium is formed on the vibrating plate 4 by, for example, the sputtering method.

Figure 8:
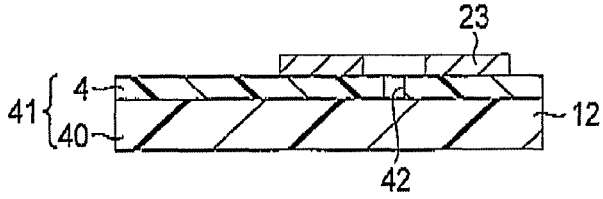
FIG. 8 is an exemplary sectional view of a state in which, in the first embodiment, the first electrode is formed on the vibrating plate.

Further, as shown in FIG. 8, for example, the photolithography and the dry etching are applied to the thin film 43 to form the ring-like first electrode 23 on the vibrating plate 4.

Figure 9:
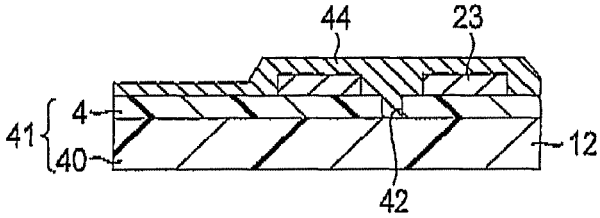
FIG. 9 is an exemplary sectional view of a state in which, in the first embodiment, the vibrating plate and the first electrode are covered with a piezoelectric film.
Figure 10:
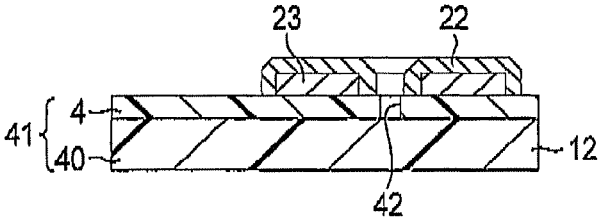
FIG. 10 is an exemplary sectional view of a state in which, in the first embodiment, a piezoelectric layer is formed on the first electrode.

Thereafter, as shown in FIG. 9, a piezoelectric film 44 made of PZT is formed on the vibrating plate 4 and the first electrode 23 by, for example, the sputtering method. Subsequently, the photolithography and wet etching are applied to the piezoelectric film 44 to form the piezoelectric layer 22, which covers the first electrode 23, on the vibrating plate 4 (see FIG. 10).

Figure 11:
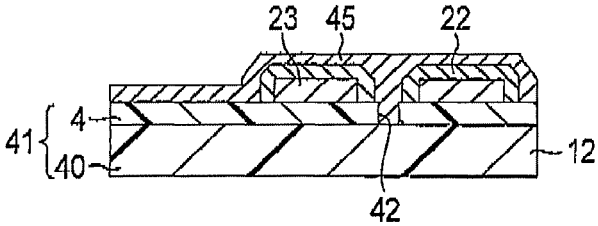
FIG. 11 is an exemplary sectional view of a state in which, in the first embodiment, a thin film, which is the base of a second electrode, is formed on the piezoelectric layer.
Figure 12:
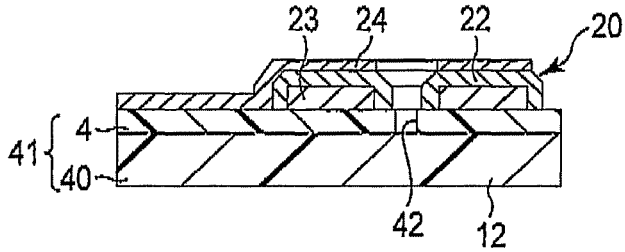
FIG. 12 is an exemplary sectional view of a state in which, in the first embodiment, the second electrode is formed on the piezoelectric layer.

Thereafter, as shown in FIG. 11, a thin film 45 of platinum or titanium is formed on the vibrating plate 4 and the piezoelectric layer 22 by, for example, the CVD method or the sputtering method. Subsequently, for example, the photolithography and the dry etching are applied to the thin film 45 to form the ring-like second electrode 24 on the vibrating plate 4 and the piezoelectric layer 22. As a result, the actuator 20 is formed on the vibrating plate 4 (see FIG. 12).

Figure 13:
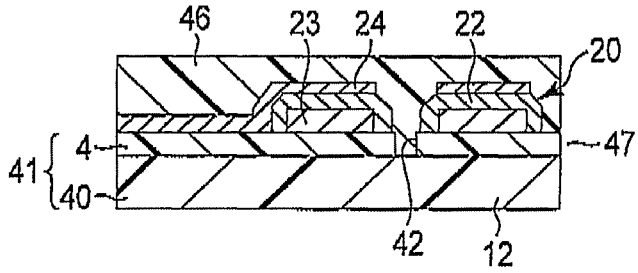
FIG. 13 is an exemplary sectional view of a state in which, in the first embodiment, an electrode protecting film is laminated on the second electrode and the vibrating plate.

Thereafter, as shown in FIG. 13, an electrode protecting film 46 is formed on the vibrating plate 4. Consequently, an intermediate molded product 47 in which the actuator 20 is covered with the electrode protecting film 46 is formed.

Figure 14:
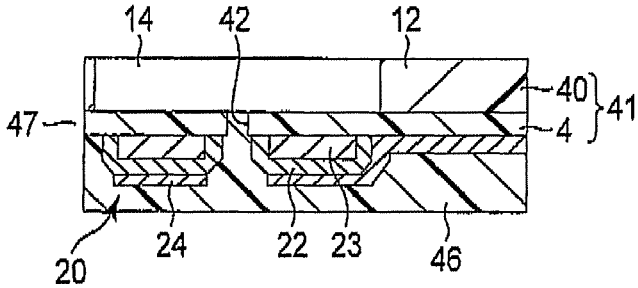
FIG. 14 is an exemplary sectional view of a state in which, in the first embodiment, an ink pressure chamber is formed in the first substrate.

Thereafter, as shown in FIG. 14, the intermediate molded product 47 is vertically reversed and the base 40 is faced upward. In this state, for example, deep reactive ion etching is applied to the base 40 to form the ink pressure chamber 14 in the base 40.

Figure 15:
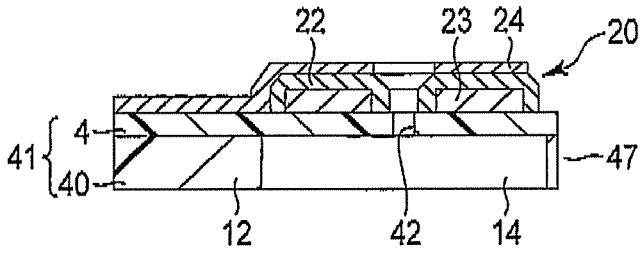
FIG. 15 is an exemplary sectional view of a state in which, in the first embodiment, the electrode protecting film is removed from the vibrating plate.

Subsequently, as shown in FIG. 15, the intermediate molded product 47 is vertically reversed again and the electrode protecting film 46 is removed. Consequently, the vibrating plate 4 and the actuator 20 are exposed.

Figure 16:
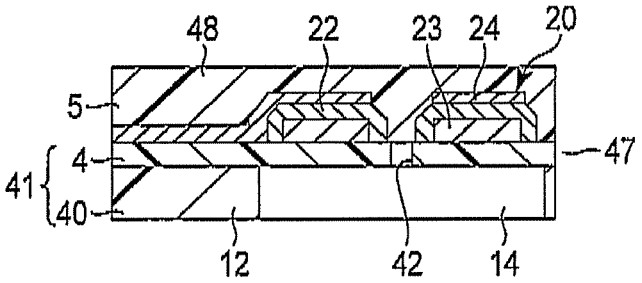
FIG. 16 is an exemplary sectional view of a state in which, in the first embodiment, a protective layer is laminated on the second electrode and the vibrating plate.

Thereafter, as shown in FIG. 16, a nozzle protecting film 48 to be the protective film 5 is formed on the vibrating plate 4 by, for example, the photolithography. The actuator 20 is covered with the nozzle protecting film 48. Further, the liquid repellent film 6 is laminated on the nozzle protecting film 48 by means such as the vapor deposition. As a result, the nozzle plate 2 incorporating the actuator 20 is formed.

Figure 17:
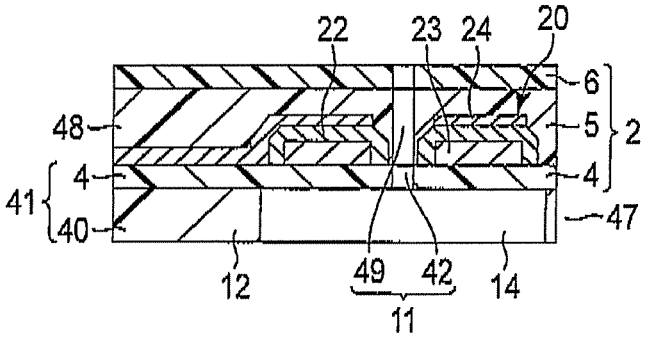
FIG. 17 is an exemplary sectional view of a state in which, in the first embodiment, a liquid repellent film is formed on the protective layer and nozzle is formed in the protective layer and the liquid repellent film.

Thereafter, as shown in FIG. 17, for example, the dry etching and ashing are applied to the nozzle protecting film 48 and the liquid repellent film 6 to form a through-hole 49 that pierces through the nozzle protecting film 48 and the liquid repellent film 6. The through-hole 49 coaxially communicates with the opening 42 of the vibrating plate 4 to form the nozzle 11.

Figure 18:
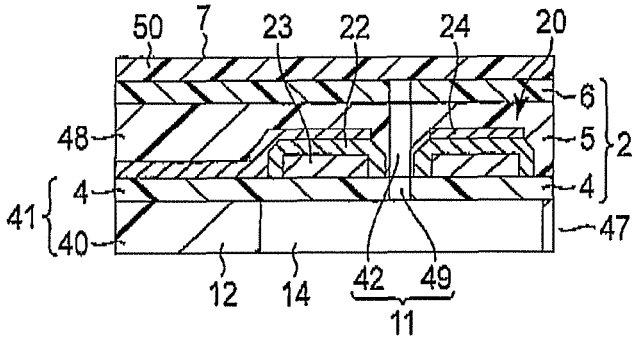
FIG. 18 is an exemplary sectional view of a state in which, in the first embodiment, a nozzle protecting film is formed on the liquid repellent film.

Subsequently, as shown in FIG. 18, a nozzle protecting film 50 is laminated on the liquid repellent film 6 to protect the opening end of the nozzle 11 and the nozzle surface 7 with the nozzle protecting film 50.

Figure 19:
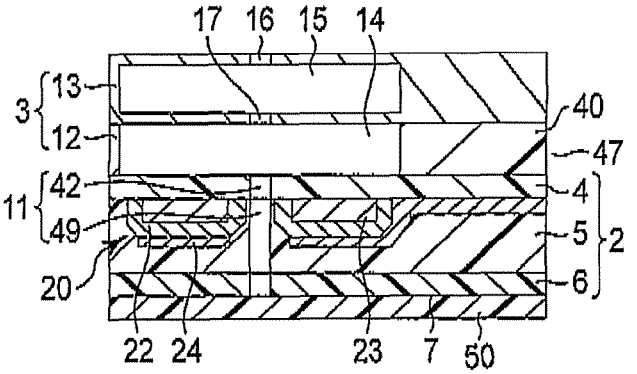
FIG. 19 is an exemplary sectional view of a state in which, in the first embodiment, a second substrate including an ink circulation chamber is bonded on the first substrate.
Figure 20:
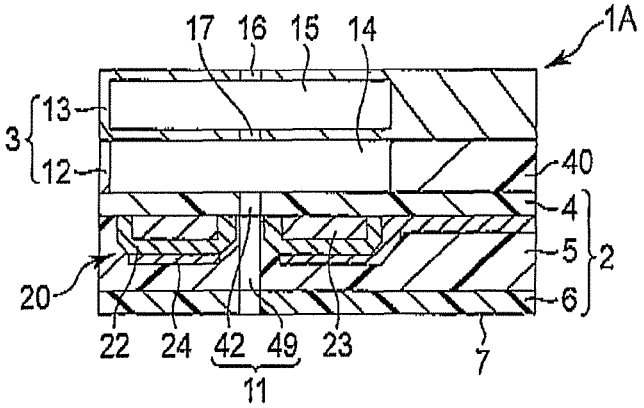
FIG. 20 is an exemplary sectional view of a state in which, in the first embodiment, the nozzle protecting film is peeled to expose the nozzles.

Thereafter, as shown in FIG. 19, the intermediate molded product 47 is vertically reversed again and the first substrate 12, in which the ink pressure chamber 14 is formed, is faced upward. In this state, the second substrate 13, in which the ink circulation chamber 15, the ink supply port 16, and the communication port 17 are formed in advance, is bonded on the first substrate 12. Consequently, the head main body 3 in which the first substrate 12 and the second substrate 13 are integrated is formed.

Finally, the nozzle protecting film 50 is peeled off the liquid repellent film 6 to expose the nozzle surface 7. The intermediate molded product 47 is cut into a size determined in advance. Consequently, a series of process for forming the first inkjet head 1A is completed.

In the first inkjet head 1A, the first energization pattern 30 and the plural second energization patterns 31 are formed on the rear surface 4*b* of the vibrating plate 4. The trunk wire 32 of the first energization pattern 30 linearly extends along the longitudinal direction of the nozzle plate 2 in the center of the nozzle plate 2 passing between the fifth actuator 20 and the sixth actuator 20 of each of the actuator rows 21.

The first electrodes 23 (the common electrodes) of the actuators 20 are electrically connected, in each of the actuator rows 21, via the wring portion 26 extending along the actuator row 21. The wiring portion 26 of each of the actuator rows 21 is electrically connected to the trunk wire 32 in the center of the nozzle plate 2.

On the other hand, the second energization patterns 31 include the first and second pattern groups 35*a* and 35*b* adjacent to the actuator row 21. The first and second pattern groups 35*a* and 35*b* are divided to hold the trunk wire 32 between the first and second pattern groups 35*a* and 35*b*.

The second electrodes 24 (the individual electrodes) of the actuators 20 includes, in each of the actuator rows 21, the wiring portions 28 extending along the longitudinal direction of the nozzle plate 2 to cross the direction in which the actuator row 21 extends. The distal ends of the wiring portions 28 are electrically individually connected to the second energization patterns 31 included in the first and second pattern groups 35*a* and 35*b*.

With such a configuration, the wiring portions 26 of the first electrodes 23 and the wiring portions 28 of the second electrode 24 are led to the rear surface 4*b* of the vibrating plate 4 to face different directions each other with respect to the piezoelectric layer 22. Therefore, the wiring portions 26 and 28 are electrically separated from each other without overlapping each other on the rear surface 4*b* of the vibrating plate 4.

Further, the second energization patterns 31 are formed in positions where the first energization pattern 30 is not formed on the rear surface 4*b* of the vibrating plate 4. Therefore, the first energization pattern 30 and the second energization patterns 31 are also electrically separated without overlapping each other on the rear surface 4*b* of the vibrating plate 4.

In addition, the first and second energization patterns 30 and 31 are separately led to the outer circumferential edge of the nozzle plate 2 and electrically connected to the tape carrier packages on the outside of the nozzle plate 2.

Therefore, although the first energization pattern 30 and the second energization patterns 31 are present on the rear surface 4*b* of the common vibrating plate 4, the first energization pattern 30 and the second energization patterns 31 do not overlap each other.

Therefore, it is possible to omit an insulating film for preventing short-circuit of the first energization pattern 30 and the second energization patterns 31. It is possible to simplify a manufacturing process for the first inkjet head 1A.

In the first embodiment, the trunk wire 32 of the first energization pattern 30 extends in the longitudinal direction of the nozzle plate 2 passing through the center along the longitudinal direction of each of the actuator rows 21. Consequently, the second energization patterns 31 are divided into the first pattern group 35*a* and the second pattern group 35*b* across the trunk wire 32.

By adopting such a configuration, a space in which at least five second energization patterns 31 are arranged only has to be secured between the adjacent actuator rows 21. Therefore, even if a space between the adjacent actuator rows 21 is narrow, it is possible to naturally arrange the second energization patterns 31 between the adjacent actuator rows 21.

Further, the trunk wire 32 passes between the fifth actuator 20 and the sixth actuator 20 among the ten actuators 20 arranged in each of the actuator rows 21. Therefore, in each of the actuator rows 21, it is possible to equalize wiring resistance to the first to fifth actuators 20 and wiring resistance to the sixth to tenth actuators 20.

Therefore, it is possible to cause the ten actuators 20 arranged in each of the actuator rows 21 to accurately operate.

In the first embodiment, the nozzle row including the ten nozzles is arranged in one hundred and twenty rows in the X direction orthogonal to the conveying direction of the sheet. However, the number of nozzle rows and the number of nozzles of one nozzle row are not limited to those in the first embodiment and can be changed as appropriate according to, for example, the resolution of an image required of an inkjet head.

Further, in the first embodiment, the plural nozzles are linearly regularly arranged in the oblique direction having a fixed angle with respect to the conveying direction of the sheet. However, the nozzles can be arranged in zigzag with respect to a straight line in the oblique direction or can be arranged in a V shape with respect to a straight line extending along the conveying direction of the sheet. A layout of the nozzles is not specifically limited.

Second Embodiment

Figure 21:
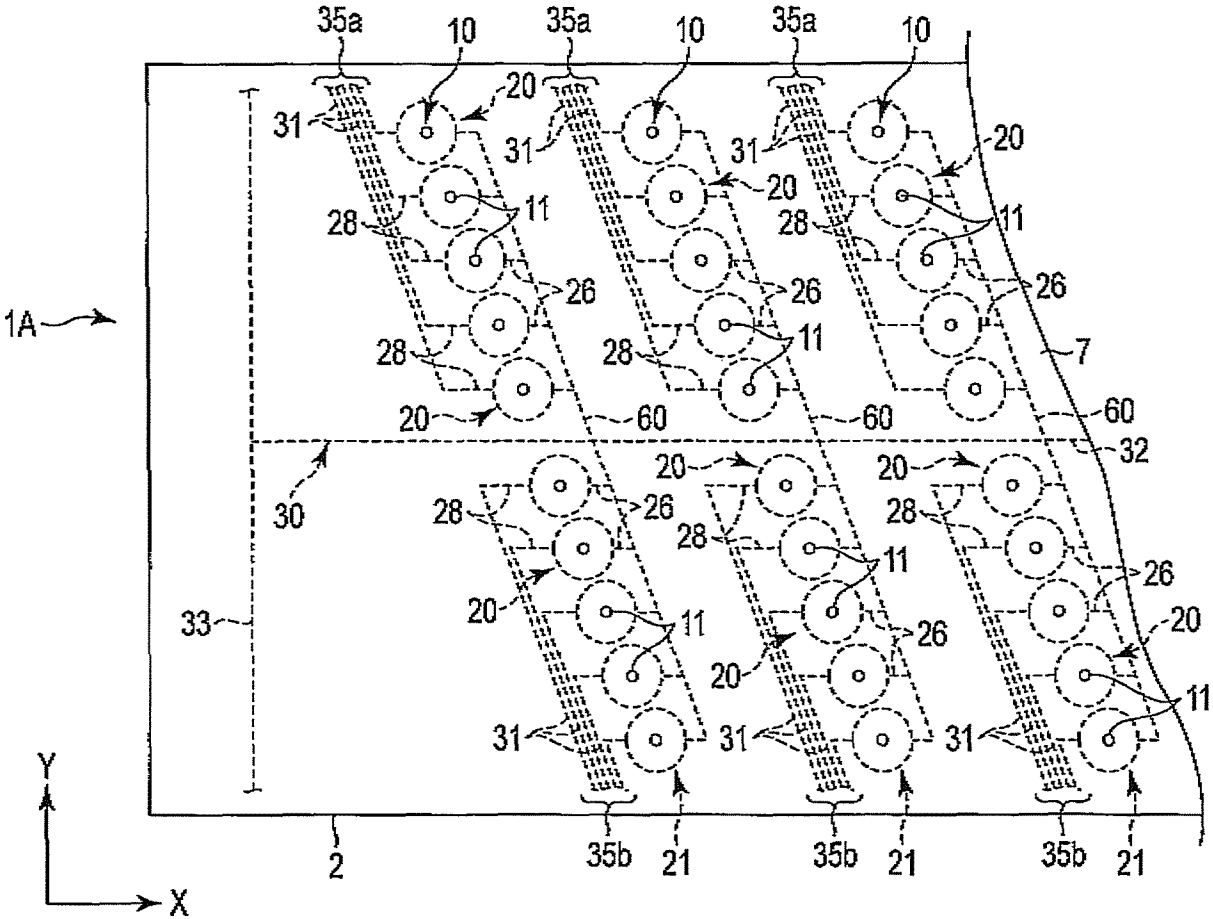
FIG. 21 is an exemplary plan view of an inkjet head according to a second embodiment.
Figure 22:
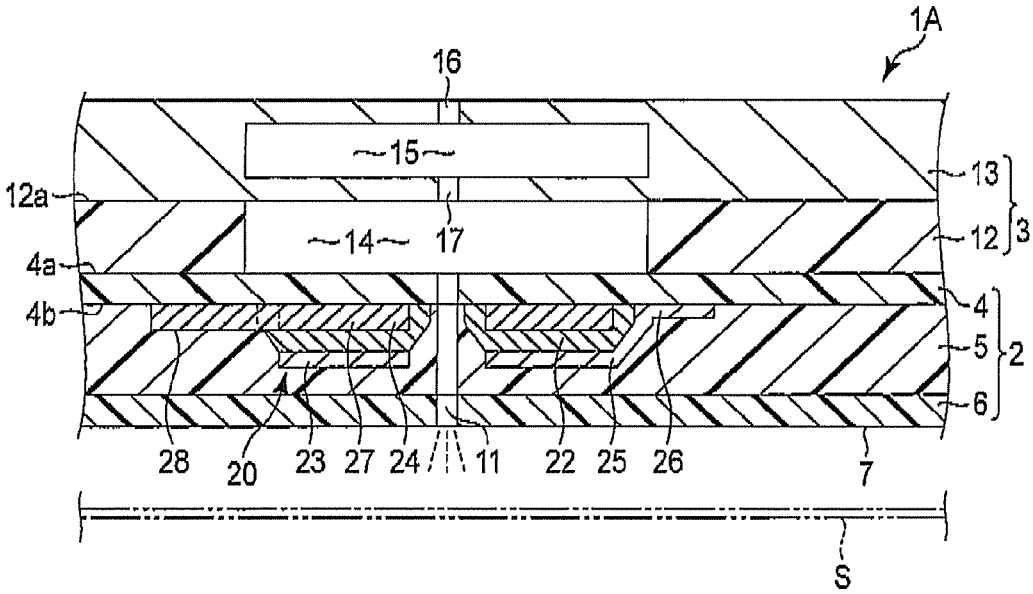
FIG. 22 is an exemplary sectional view of the inkjet head according to the second embodiment.
Figure 23:
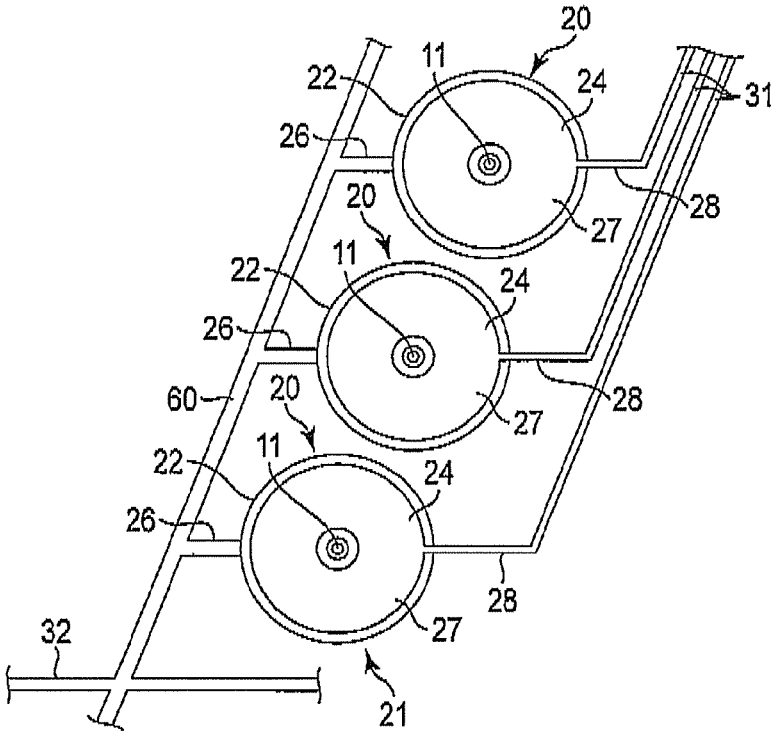
FIG. 23 is an exemplary plan view for explaining a positional relation between a wiring portion connected to a common electrode of an actuator and a wiring portion connected to individual electrodes of the actuator in the second embodiment.

A second embodiment is shown in FIGS. 21 to 23. The second embodiment is different from the first embodiment in a relative positional relation between the first electrode 23 and the second electrode 24 of the actuator 20. Otherwise, the configuration of the first inkjet head 1A is the same as that in the first embodiment. Therefore, in the second embodiment, components same as those in the first embodiment are denoted by the same reference numerals and signs and explanation of the components is omitted.

In the second embodiment, the second electrode 24 (the individual electrode) of the actuator 20 is formed on the rear surface 4*b* of the vibrating plate 4. The second electrode 24 includes the ring-like electrode portion 27 and the wiring portion 28.

The electrode portion 27 is coaxially covered with the piezoelectric layer 22 and electrically connected to the piezoelectric layer 22. The wiring portion 28 is led from the outer circumferential edge of the electrode portion 27 to the rear surface 4*b* of the vibrating plate 4 piercing through the piezoelectric layer 22. As shown in FIG. 21, the wiring portion 28 extends, for example, along the longitudinal direction of the nozzle plate 2 to cross the direction in which the actuator row 21 extends.

Therefore, the wiring portions 28 are arrayed spaced apart from one another in the conveying direction of the sheet S in each of the actuator rows 21.

On the other hand, the first electrode 23 (the common electrode) of the actuator 20 includes the ring-like electrode portion 25 and the wiring portion 26. The electrode portion 25 is coaxially laminated on the piezoelectric layer 22 and electrically connected to the piezoelectric layer 22. The wiring portion 26 is led from the outer circumferential edge of the electrode portion 25 to the rear surface 4*b* of the vibrating plate 4 through the outer circumferential portion of the piezoelectric layer 22.

The wiring portion 26 extends, for example, along the longitudinal direction of the nozzle plate 2 to cross the direction in which the actuator row 21 extends. Further, the wiring portion 26 is led to the opposite side of the wiring portion 28 of the second electrode 24 with respect to the piezoelectric layer 22.

The wiring portions 26 of the first electrodes 23 are electrically connected via a relay wiring portion 60 in each of the actuator rows 21. The relay wiring portion 60 is formed on the rear surface 4*b* of the vibrating plate 4 to extend along the actuator row 21.

Consequently, the wiring portion 26 of the first electrode 23 and the wiring portion 28 of the second electrode 24 are separated from each other without overlapping each other on the rear surface 4*b* of the vibrating plate 4.

As shown in FIG. 21, the trunk wire 32 of the first energization pattern 30 is formed to cross the relay wiring portion 60 between the fifth actuator 20 and the sixth actuator 60 of the actuator row 21 and electrically connected to the relay wiring portion 60.

Therefore, the trunk wire 32 of the first energization pattern 30 is connected to the first electrodes 23 of all the actuators 20 in common. Consequently, the first electrode 23 acts as a common electrode that applies a fixed voltage to all the piezoelectric layers 22.

The second energization patterns 31 include the first pattern group 35*a* corresponding to the first to fifth actuators 20 and the second pattern group 35*b* corresponding to the sixth to tenth actuators 20.

One ends of the five second energization patterns 31 included in the first pattern group 35*a* are individually electrically connected to the distal ends of the wiring portions 28 of the second electrodes 24 of the first to fifth actuators 20. The other ends of the second energization patterns 31 are led to the outer edge extending along the longitudinal direction of the nozzle plate 2.

One ends of the five second energization patterns 31 included in the second pattern group 35*b* are individually electrically connected to the distal ends of the wiring portions 28 of the second electrodes 24 of the sixth to tenth actuators 20. The other ends of the second energization patterns 31 are led to the outer edge extending along the longitudinal direction of the nozzle plate 2.

As a result, the second energization patterns 31 are individually connected to the second electrodes 24 of all the actuators 20. Consequently, the second electrodes 24 act as individual electrodes that cause the respective piezoelectric layers 22 to independently operate.

According to the second embodiment, the second energization patterns 31 are formed in positions where the first energization patterns 30 are not formed on the rear surface 4*b* of the vibrating plate 4. As a result, the first energization pattern 30 and the second energization patterns 31 are kept in an electrically separated state without overlapping each other on the rear surface 4*b* of the vibrating plate 4.

Therefore, as in the first embodiment, it is possible to omit an insulating film for preventing short-circuit of the first energization pattern 30 and the second energization patterns 31.

Third Embodiment

Figure 24:
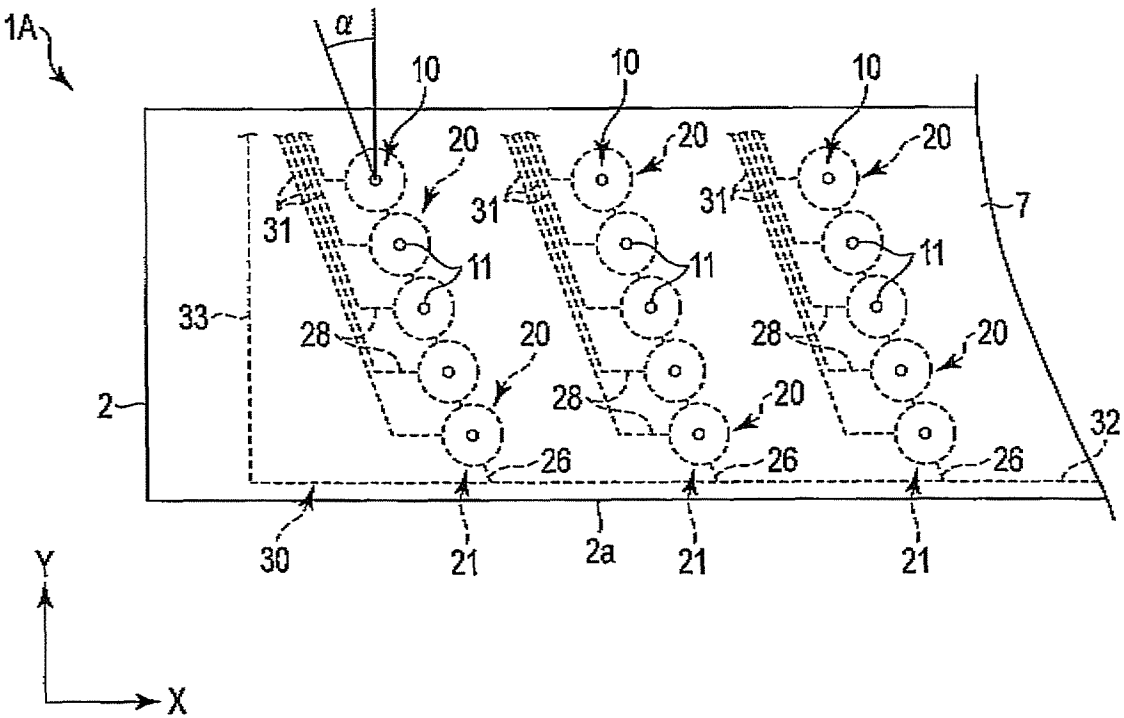
FIG. 24 is an exemplary plan view of an inkjet head according to a third embodiment.

A third embodiment is shown in FIG. 24. The third embodiment is different from the first embodiment in the number of the actuators 20 included in one actuator row 21 and the first energization pattern 30. Otherwise, the configuration of a first inkjet head 1 is basically the same as that in the first embodiment. Therefore, in the third embodiment, components same as those in the first embodiment are denoted by the same reference numerals and signs and explanation of the components is omitted.

In the third embodiment, each of the nozzle rows 10 includes five nozzles 11. The nozzles 11 are linearly arrayed spaced apart from one another in an oblique direction having a fixed angle $\alpha$ with respect to the conveying direction of the sheet S.

The actuators 20 incidental to the nozzles 11 form the plural actuator rows 21 corresponding to the plural nozzle rows 10. Each of the actuator rows 21 includes five actuators 20.

The trunk wire 32 of the first energization pattern 30 is arranged between one outer edge 2*a* extending along the longitudinal direction of the nozzle plate 2 and one end of the actuator row 21. In other words, the trunk wire 32 is linearly arranged along the longitudinal direction of the nozzle plate 2 passing through the actuator 20 located at one end along the longitudinal direction of the actuator row 21 and the outer edge 2*a* of the nozzle plate 2.

The extending portion 33 of the first energization pattern 30 extends in a direction orthogonal to the trunk wire 32 from one end of the trunk wire 32. The distal end of the extending portion 33 is led in the same direction as a drawing-out direction of the second energization pattern 31.

In the third embodiment, the wiring portion 26 located at one end along the longitudinal direction of the actuator row 21 is connected to the trunk wire 32. Therefore, the wiring portion 26 of each of the actuator rows 21 is divided in the same direction from the trunk wire 32.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a plurality of nozzles provided on a nozzle plate and arrayed spaced apart from one another; and a plurality of actuators provided for the respective nozzles and configured to pressurize ink and eject the ink from the nozzles, the actuators including piezoelectric elements provided on an insulating layer, first electrodes electrically connected to the piezoelectric elements, and second electrodes electrically connected to the piezoelectric elements and configured to hold the piezoelectric elements in cooperation with the first electrodes, the first electrodes of the actuators being electrically connected to a common first energization pattern provided on the insulating layer, the second electrodes of the actuators being individually electrically connected to a plurality of second energization patterns provided on the insulating layer, and the first energization pattern and the second energization patterns being separated from each other without overlap in a thickness direction of the insulating layer, the actuators, the first energization pattern and the second energization patterns being provided within a range defined by a thickness dimension of the nozzle plate.

2. The inkjet head of claim 1, wherein the nozzles are formed on a nozzle plate including the insulating layer, and the actuators are incorporated in the nozzle plate to surround the nozzles.

3. The inkjet head of claim 2, wherein the first electrodes of the actuators adjacent to each other in an arraying direction of the nozzles are electrically connected via a wiring portion extending between outer circumferential portions of the piezoelectric elements, and the wiring portion is electrically connected to the first energization pattern on the insulating layer.

4. The inkjet head of claim 3, wherein the second electrodes include wiring portions routed from the outer circumferential portions of the piezoelectric elements onto the insulating layer in a direction different from the wiring portions of the first electrodes, and the wiring portions of the second electrodes are electrically connected to the second energization patterns on the insulating layer.

5. An inkjet head comprising:

a head main body including a plurality of ink pressure chambers to which ink is supplied;

a nozzle plate laminated on the head main body, the nozzle plate including a displaceable insulating layer exposed to the plurality of ink pressure chambers and a plurality of nozzles piercing through the insulating layer, each nozzle of plurality of nozzles being individually provided to communicate with a respective ink pressure chamber of the plurality of ink pressure chambers; and a plurality of actuators provided on the insulating layer, each actuator of the plurality of actuators corresponding to a respective nozzle and configured to pressurize ink supplied to a respective ink pressure chamber and eject the ink from the respective nozzle, each actuator including a piezoelectric element, a first electrode electrically connected to the piezoelectric element, and a second electrode electrically connected to the piezoelectric element and configured to hold the piezoelectric element in cooperation with the first electrode, a plurality of first wiring portions each of which electrically connects each first electrode to a common first energization pattern, a plurality of second wiring portions each of which electrically connects each second electrode to a second energization pattern, the first and second wiring portions being led from outer circumferential portions of each piezoelectric element in a direction different from each other and separated from each other without overlap in a thickness direction of the insulating layer, the actuators, the first energization pattern and the second energization patterns being provided within a range defined by a thickness dimension of the nozzle plate.

6. The inkjet head of claim 5, wherein the insulating layer includes the common first energization pattern to which the wiring portions of the first electrodes of the actuators are electrically connected and the second energization pattern to which the wiring portions of the second electrodes of the actuators are individually electrically connected, and the common first energization pattern and the second energization pattern are separated from each other on the insulating layer.

7. The inkjet head of claim 5, wherein the nozzle plate includes a plurality of nozzle rows, each nozzle row further including a distinct plurality of nozzles, and each of the nozzle rows extending in a longitudinal direction of the nozzle plate;

wherein the nozzle rows are arrayed spaced apart from one another in a first direction different from the longitudinal direction.

8. The inkjet head of claim 5, wherein the common energization pattern has wiring portions passing through two nozzles adjacent to each other in a center along a longitudinal direction of the nozzle rows, and the wiring portions extending along the nozzle rows to electrically couple to the common energization pattern.

9. The inkjet head of claim 8, wherein the second energization patterns are arranged spaced apart from one another in a direction in which the nozzle rows extend, such second energization patterns being in positions apart from the common energization pattern.

10. An inkjet recording apparatus comprising:

a conveying path for conveying a recording medium; and an inkjet head configured to eject ink to the recording medium to form an image on the recording medium, the inkjet head including:

a plurality of nozzles provided on a nozzle plate and arrayed spaced apart from one another; and a plurality of actuators provided for the respective nozzles, the actuators including piezoelectric elements provides on an insulating layer, first electrodes electrically connected to the piezoelectric elements, and second electrodes electrically connected to the piezoelectric elements and configured to hold the piezoelectric elements in cooperation with the first electrodes, wherein the first electrodes are electrically connected to a common first energization pattern provided on the insulating layer, and the second electrodes are individually electrically connected to plurality of second energization patterns provided on the insulating layer, and the common first energization pattern and the plurality of second energization patterns being separated from each other without overlap in a thickness direction of the insulating layer, the actuators, the first energization pattern and the second energization patterns being provided within a range defined by a thickness dimension of the nozzle plate.

11. An inkjet head comprising:

an insulating layer;

a nozzle plate comprising the insulating layer;

an ink pressure chamber which is supplied with ink and fluidly communicates with a nozzle piercing the insulating layer;

a first electrode provided to the insulating layer;

a piezoelectric element which is electrically connected to the first electrode and is sized such that the piezoelectric element covers the first electrode and a perimeter of the piezoelectric element is brought into contact with the insulating layer;

a second electrode which is formed on the piezoelectric element such that the piezoelectric element is interposed between the first and second electrodes;

a first common energization pattern which is commonly electrically connected to one group of a first group having a plurality of first electrodes electrode layers and a second group having a plurality of second electrodes electrode layers; and a second individual energization pattern which in individually electrically connected to the other group, the second individual energization pattern being arranged to separate from the first common energization pattern without overlapping each other on the insulating layer, the actuators, the first energization pattern and the second energization patterns being provided within a range defined by a thickness dimension of the nozzle plate.

12. The inkjet head of claim 11, wherein the nozzle is formed in the insulating layer, and the piezoelectric layer is provided to surround the nozzle.

13. The inkjet head of claim 11, wherein the first electrode is one of a plurality of first electrodes, each first electrode being adjacent to one another in an arraying direction of the nozzles and being electrically connected to one another via a wiring portion extending between an outer circumferential portion of the electrode, wherein the wiring portion is electrically connected to the first common energization pattern.

14. The inkjet head of claim 13, wherein the second electrode includes a wiring portion extending outward from the second electrode in a direction different from the wiring portion of the first electrode, wherein the wiring portion of the second electrode is electrically connected to the second individual energization pattern.

15. The inkjet head of claim 11, wherein the second electrode is one of a plurality of second electrodes, each second electrode being adjacent to one another in an arraying direction of the nozzles and being electrically connected to one another via a wiring portion extending between an outer circumferential portion of each electrode, wherein the wiring portion is electrically connected to the common energization pattern.

16. The inkjet head of claim 15, wherein the first electrode includes a wiring portion extending outward from the first electrode in a direction different from the wiring portion of the second electrode, wherein the wiring portion of the first electrode is electrically connected to the second individual energization pattern.

* * * * *